US008175317B2

(12) United States Patent
Nakano

(10) Patent No.: US 8,175,317 B2
(45) Date of Patent: May 8, 2012

(54) AUDIO REPRODUCING APPARATUS AND AUDIO REPRODUCING METHOD

(75) Inventor: Kenji Nakano, Kanagawa (JP)

(73) Assignee: Sony Corporation, Tokyo (JP)

( * ) Notice: Subject to any disclaimer, the term of this patent is extended or adjusted under 35 U.S.C. 154(b) by 1190 days.

(21) Appl. No.: 11/581,665

(22) Filed: Oct. 16, 2006

(65) Prior Publication Data

US 2007/0092099 A1 Apr. 26, 2007

(30) Foreign Application Priority Data

Oct. 26, 2005 (JP) ..... 2005-311508

(51) Int. Cl.
*H04R 1/02* (2006.01)

(52) U.S. Cl. ..... 381/387

(58) Field of Classification Search ..... 381/77, 381/387, 307, 310, 334–336
See application file for complete search history.

(56) References Cited

U.S. PATENT DOCUMENTS

| | | | | |
|---|---|---|---|---|
| 4,633,229 | A * | 12/1986 | Iacono et al. | 340/384.4 |
| 5,233,664 | A * | 8/1993 | Yanagawa et al. | 381/89 |
| 5,953,432 | A * | 9/1999 | Yanagawa et al. | 381/335 |
| 7,362,874 | B2 * | 4/2008 | Lee et al. | 381/307 |
| 7,529,376 | B2 * | 5/2009 | Konagai | 381/97 |
| 2007/0019816 | A1 | 1/2007 | Konagai | |
| 2007/0269071 | A1 * | 11/2007 | Hooley | 381/336 |

FOREIGN PATENT DOCUMENTS

| | | | |
|---|---|---|---|
| JO | 63-54898 | | 3/1988 |
| JP | 57-34772 | | 2/1982 |
| JP | 2-60400 | | 2/1990 |
| JP | 2-230899 | | 9/1990 |
| JP | 4-351197 | | 12/1992 |
| JP | 5-14992 | | 1/1993 |
| JP | 5-137200 | | 6/1993 |
| JP | 8-19089 | | 1/1996 |
| JP | 9-98495 | | 4/1997 |
| JP | 9-247784 | | 9/1997 |
| JP | 11-27604 | | 1/1999 |
| JP | 2000-295697 | A | 10/2000 |
| JP | 2003-87888 | A | 3/2003 |
| JP | 2003-235092 | A | 8/2003 |
| JP | 2005-123893 | A | 5/2005 |
| WO | WO 2005/032207 | A1 | 4/2005 |

* cited by examiner

*Primary Examiner* — Xu Mei
(74) *Attorney, Agent, or Firm* — Wolf, Greenfield & Sacks, P.C.

(57) ABSTRACT

An audio reproducing apparatus is disclosed. The audio reproducing apparatus includes a plurality of speaker units and a directivity controlling section. The radiation surfaces of the plurality of speaker units outwardly face. The directivity controlling section controls directivities of the plurality of speaker units so as to form one or a plurality of low sensitivity regions.

11 Claims, 3 Drawing Sheets

AUDIO REPRODUCING APPARATUS AND AUDIO REPRODUCING METHOD

CROSS REFERENCES TO RELATED APPLICATIONS

The present invention contains subject matter related to Japanese Patent Application JP 2005-311508 filed in the Japanese Patent Office on Oct. 26, 2005, the entire contents of which being incorporated herein by reference.

BACKGROUND OF THE INVENTION

1. Field of the Invention

The present invention relates to an audio reproducing apparatus and an audio reproducing method that control directivities of a plurality of speakers to form one or a plurality of low sensitive regions.

2. Description of the Related Art

So far, to control directivities of speakers, various proposals have been made. For example, a related art reference disclosed as Japanese Patent Application Laid-Open No. SHO 63-54898 describes a speaker system that obtains a single directivity. In this speaker system, one side of a diaphragm or a vibration membrane is covered with a sound absorbing material so as to suppress occurrence of crests and troughs in sound pressure and frequency characteristics.

Another related art reference disclosed as Japanese Patent Application Laid-Open No. HEI 9-247784 descries an audio reproducing apparatus that supplies audio signals that have been processed by filters having predetermined transfer functions to a pair of speakers disposed in one enclosure where their rear surfaces face each other and electrically controls the transfer functions so as to obtain a desired directivity.

SUMMARY OF THE INVENTION

It may be desirable that a particular person or group is caused to hear a particular sound and people around the particular person or group is caused to not hear the particular sound. For example, when an audio reproducing apparatus having a plurality of speaker units is disposed on a table, a first person may listen to music with one speaker unit, a second person may listen to a television broadcast sound with another speaker unit, and a third person may be caused to not hear these sounds. When a person who listens to a sound uses a headset, the sound can be prevented from leaking into other people. However, it is bothersome for a listener to wear a headset.

The foregoing related art references describe achievement of desired directivities, not formation of a region in which a person is unable to hear a reproduced sound.

In view of the foregoing, it would be desirable to provide an audio reproducing apparatus and an audio reproducing method that control directivities of a plurality of speaker units so as to form a low sensitivity region in which a person is unable to hear a sound reproduced from a speaker unit apart from him or her.

According to an embodiment of the present invention, there is provided an audio reproducing apparatus including a plurality of speaker units and a directivity controlling section. The radiation surfaces of the plurality of speaker units outwardly face. The directivity controlling section controls directivities of the plurality of speaker units so as to form one or a plurality of low sensitivity regions.

According to an embodiment of the present invention, there is provided an audio reproducing apparatus including a plurality of speaker units whose radial surfaces outwardly face. Weighting factors for the plurality of speaker units are calculated so that the sum of the directivities of the plurality of speaker units becomes 0. Audio signals multiplied by the weighting factors are supplied to the plurality of speaker units and reproduced therefrom so as to form one or a plurality of low sensitivity regions.

According to an embodiment of the present invention, there is provided an audio reproducing method of reproducing audio signals from a plurality of speaker units. Directivities of the plurality of speaker units are controlled so that the sum of the directivities of the plurality of speaker units becomes 0 so as to form one or a plurality of low sensitivity regions.

According to embodiments of the present invention, sounds to which listeners who are present in different directions of a plurality of speaker units of an audio reproducing apparatus listen can be prevented from leaking into other listeners. Thus, a sound can be provided to a particular listener so that other people around the particular listener are caused to not hear the sound.

These and other objects, features and advantages of the present invention will become more apparent in light of the following detailed description of a best mode embodiment thereof, as illustrated in the accompanying drawings.

DETAILED DESCRIPTION OF THE PREFERRED EMBODIMENTS

Figure 1:
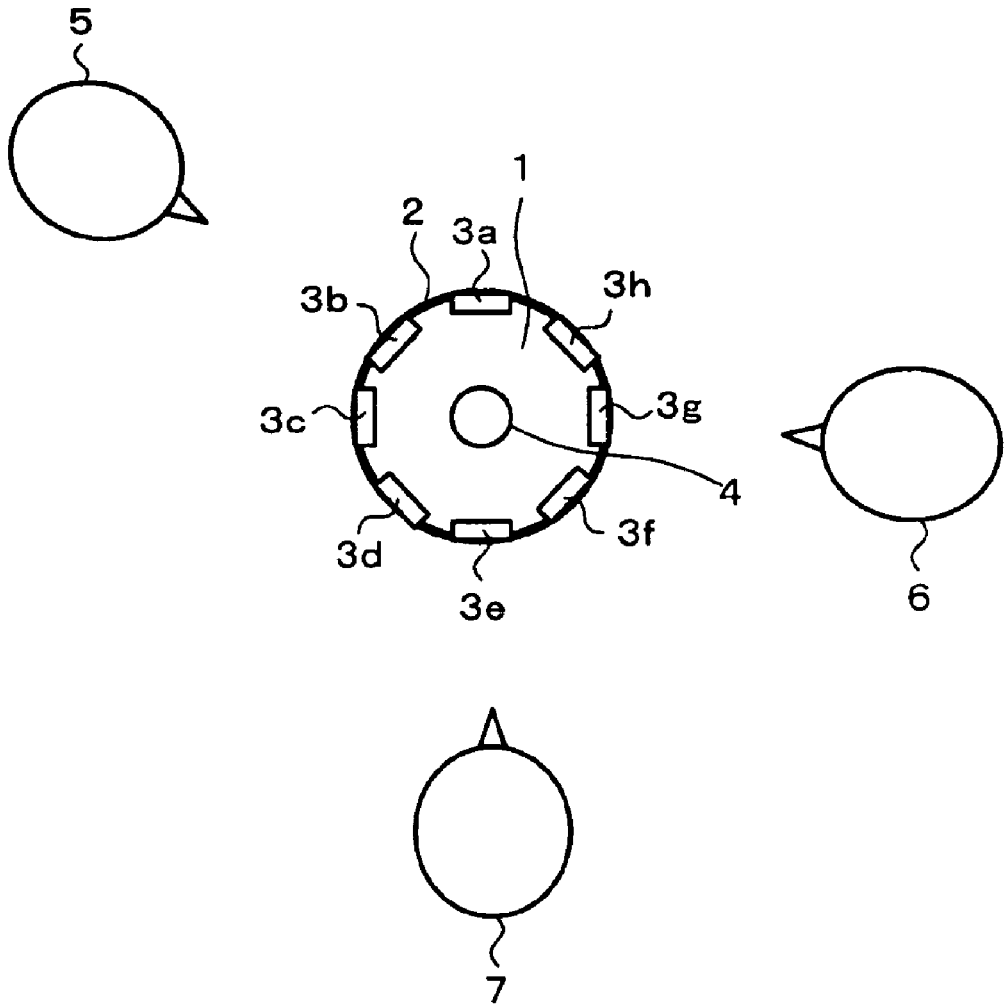
FIG. 1 is a schematic diagram showing an outline of an audio reproduction environment according to an embodiment of the present invention.

Next, with reference to accompanying drawings, an embodiment of the present invention will be described. FIG. 1 shows an outline of an audio reproduction environment according to an embodiment of the present invention. An audio reproducing apparatus 1 according to this embodiment includes a circularly cylindrical enclosure 2 and speaker units 3*a* to 3*h*. The speaker units 3*a* to 3*h* are radially disposed on a plurality of baffle plates disposed on the peripheral surface of the circularly cylindrical enclosure 2.

Listeners who are present around the audio reproducing apparatus 1 listen to their desired sounds with the speaker units 3*a* to 3*h*. For example, as shown in FIG. 1, a listener 5 listens to his or her desired sound with the speaker unit 3*b* disposed in front of the listeners. A listener 6 listens to his or her desired sound with the speaker unit 3*g*. A listener 7 listens to his or her desired sound with the speaker unit 3*e*.

The positions of the listeners around the audio reproducing apparatus 1 are determined for example by a camera unit 4 disposed therein. The camera unit 4 can capture images at 360 degrees in all the directions. The audio reproducing apparatus 1 analyzes captured image data to determine the positions of the listeners therearound. Assuming that the radial direction of the speaker unit 3*a* is 0 degrees, the position of the listener 5 is defined for example as 315 degrees, the position of the listener 6 for example as 90 degrees, and the position of the listener 7 for example as 180 degrees. Instead, the speaker units used by the listeners may be determined corresponding to the positions of the listeners. In addition, the distance from each speaker unit to the corresponding listener may be measured.

The positions of the listeners and the distances between the listeners and the speaker units may be measured by other than the camera unit 4. For example, an ultra sonic wave may be emitted in the radial direction of each speaker unit. By detecting a reflection wave from each listener against the ultra sonic wave, the position and distance of each listener may be determined. Instead, by emitting an infrared ray from a remote controller or pressing a predetermined button of the audio reproducing apparatus 1, each listener may inform the audio reproducing apparatus 1 of his or her position. Instead, each speaker unit may be used as a microphone. In this case, by detecting a time difference between the time period for which each listener speaks and the time period for which a sound wave of the listener reaches the microphone, the position and distance of each listener may be determined.

The audio reproducing apparatus 1 is provided with a signal processing section that performs a signal process for audio signals. The signal processing section will be described later. The audio signals that have been processed are reproduced from the speaker units 3*a* to 3*h*. Instead, the signal processing section may be disposed outside the audio reproducing apparatus 1. In this case, the signal processing section may be connected wirelessly or by cables to the speaker units 3*a* to 3*h* so that the audio signals are exchanged with the audio reproducing apparatus 1.

Figure 2:
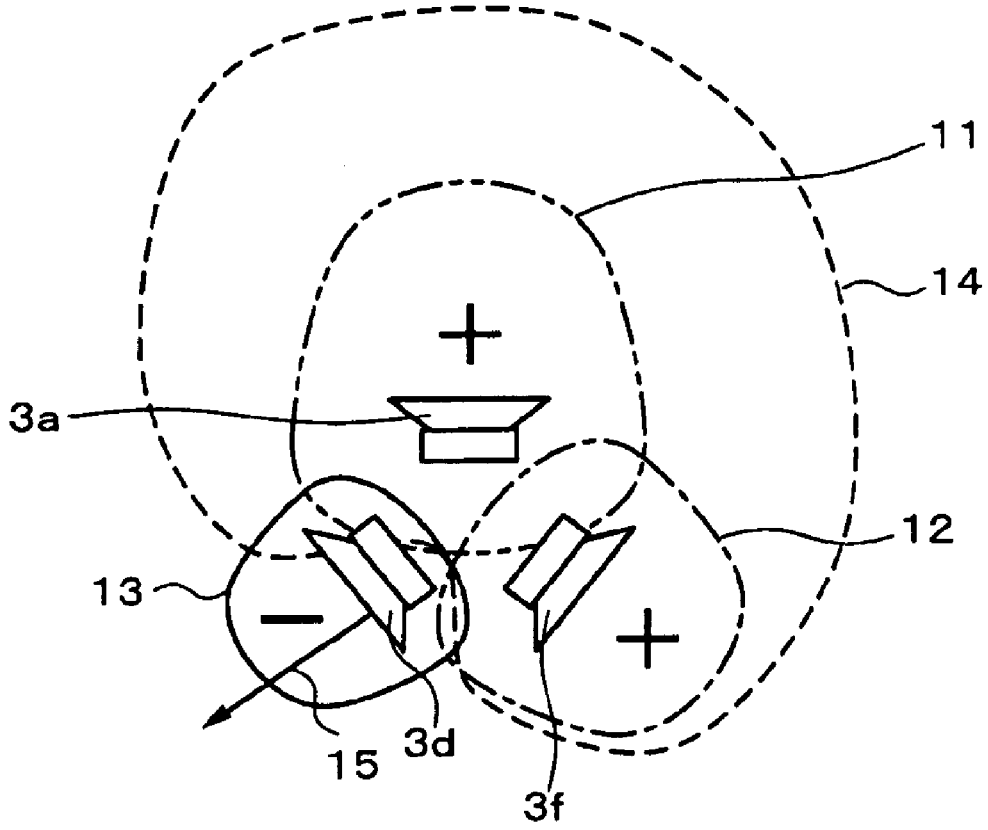
FIG. 2 is a schematic diagram describing formation of a low sensitivity region by combining patterns having directivities.

FIG. 2 conceptually shows a method of varying levels and phases of audio signals reproduced from the plurality of speaker units and forming one or a plurality of low sensitivity regions. For simplicity, FIG. 2 shows only the speaker units 3*a*, 3*d*, and 3*f* of the audio reproducing apparatus 1 shown in FIG. 1.

For example, the same audio signal (hereinafter referred to as the audio signal A) is supplied to each speaker unit. The audio signal A is properly set so that the input levels of the audio signal A for the speaker units 3*a*, 3*f*, and 3*d* increase in these order and so that the phase of the audio signal A reproduced from the speaker 3*a* and the speaker 3*f* is reverse of the phase of the audio signal A reproduced from the speaker 3*d*.

As a result, the directivity of the speaker unit 3*a* is denoted for example as a pattern of a two-dotted line 11. The directivity of the speaker unit 3*f* is denoted for example as a pattern of a one-dotted line 12. The directivity of the speaker unit 3*d* is denoted for example as a pattern of a solid line 13. These directivities are combined for example as a pattern of a broken line 14.

Since the levels of the audio signal of the individual speaker units are different and the phases of the reproduced audio signal are reverse, the audio signals are cancelled. Thus, the area around the speaker unit 3*d* is outside the area denoted by the broken line 14. As a result, the listener who is present in front of the speaker unit 3*d* can be caused to not hear the audio signal A. Thus, when the levels and phases of the audio signal are adjusted, a low sensitivity region can be formed. As a result, the level of the audio signal can be much suppressed for the listener who does not want to listen to the audio signal that is reproduced.

As described above, when the levels and phases of an audio signal are adjusted and listeners listen to the audio signal with a plurality of speaker units, a low sensitivity region can be formed. In addition, according to an embodiment of the present invention, by controlling the directivity of each speaker unit, one or a plurality of low sensitivity regions can be formed.

Figure 3:
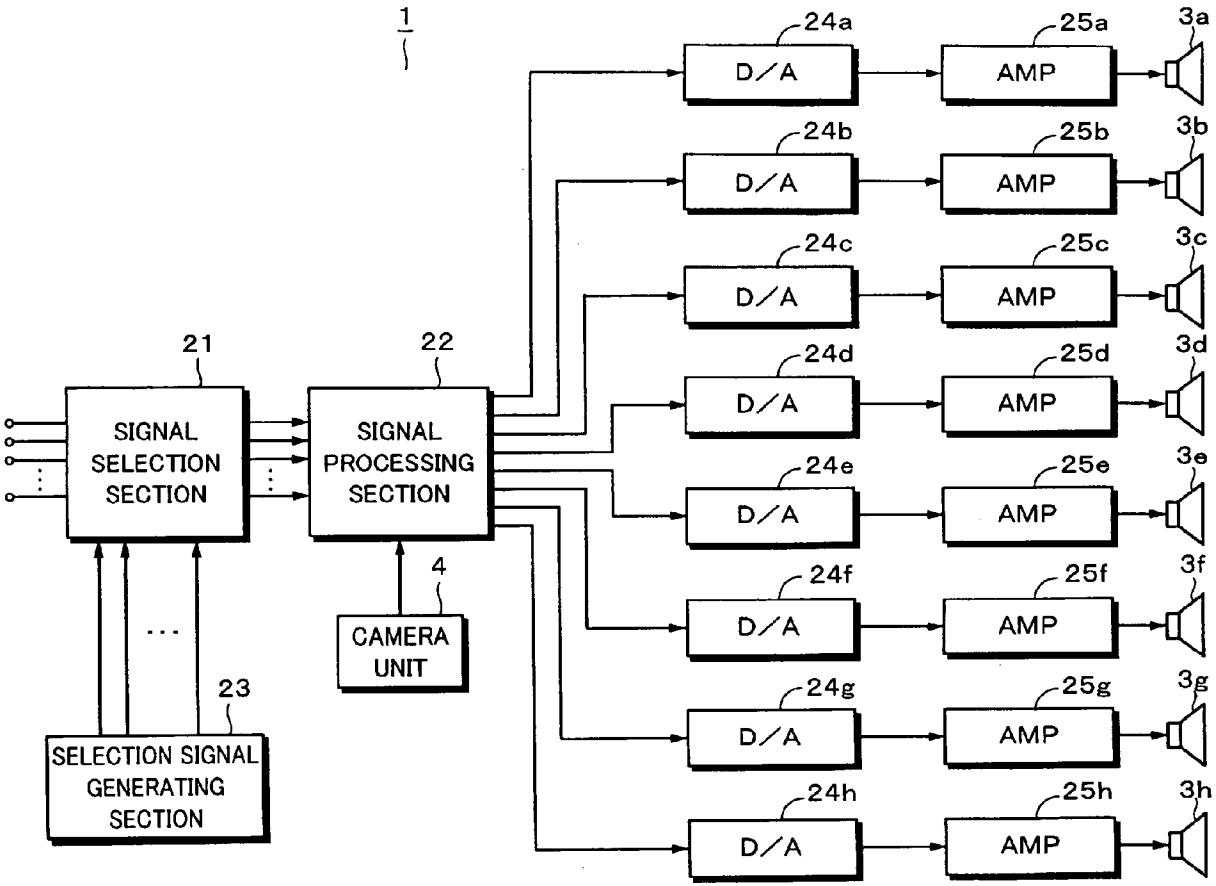
FIG. 3 is a block diagram showing a structure of an audio reproducing apparatus according to an embodiment of the present invention.

Next, this embodiment will be described in detail. FIG. 3 shows the structure of the audio reproducing apparatus 1 according to this embodiment. The audio reproducing apparatus 1 includes a signal selection section 21, a signal processing section 22 as an example of a directivity controlling section, and a camera unit 4. In addition, as described above, the audio reproducing apparatus 1 has the speaker units 3*a* to 3*h*. Moreover, the audio reproducing apparatus 1 has Digital to Analog (D/A) converting sections 24*a* to 24*h* and amplifiers (AMPs) 25*a* to 25*h*. The D/A converting sections 24*a* to 24*h* convert digital audio signals supplied to speaker units into corresponding analog audio signals. The AMPs 25*a* to 25*h* amplify the analog audio signals.

Various source audio signals are input to the signal selection section 21. Examples of the source audio signals include a television broadcast sound, a radio broadcast sound, and music recorded in a removable medium and a Hard Disk Drive (HDD). Instead, the audio reproducing apparatus 1 may be provided with a network interface so that an audio signal is downloaded through a network such as the Internet and a downloaded audio signal is supplied to the signal selection section 21.

The signal selection section 21 performs a process of selecting a predetermined audio signal from a plurality of audio signals that are supplied. For example, a listener who is present around the audio reproducing apparatus 1 transmits an infrared remote control signal to the audio reproducing apparatus 1 to select a desired audio signal with a remote control unit. The remote control signal is received by a light receiving section (not shown) of the audio reproducing apparatus 1 and then supplied to a selection signal generating section 23. The selection signal generating section 23 generates a selection signal corresponding to the remote control signal. The selection signal is supplied from the selection signal generating section 23 to the signal selection section 21. The signal selection section 21 performs a process of selecting a predetermined audio signal corresponding to the supplied audio signal. Since there may be a plurality of listeners around the audio reproducing apparatus 1, a plurality of selection signals corresponding to the plurality of listeners may be supplied to the signal selection section 21. In this case, a plurality of audio signals may be selected. The audio signal selected by the signal selection section 21 is supplied to the signal processing section 22.

In addition, position information about listeners obtained by the capturing and analyzing processes of the camera unit 4 is supplied to the signal processing section 22. As was described with reference to FIG. 1, position information about the listeners 5 to 7 is supplied from the camera unit 4 to the signal processing section 22.

For example, it is assumed that the listener 6 has selected an audio signal B and the audio signal B has been supplied to the signal processing section 22 and that the listeners 5 and 7 have not selected the audio signal B. If the audio signal B is converted into an analog signal, amplified, and reproduced from the speaker unit 3*g* disposed in front of the listener 6, the reproduced sound leaks into the surrounding listeners 5 and 7. In particular, if the audio signal B contains many low frequency components, since their wavelengths are long, the directivity of the audio signal B widens. Thus, the influence of the sound leakage to the surrounding listeners may become large.

Thus, the signal processing section 22 performs a process of causing the listener 6 to hear the audio signal B and forming low sensitivity regions around the listener 5 and the listener 7 so that they are unable to hear the audio signal B. The process executed by the signal processing section 22 will be described later in detail.

The audio signal B for which a signal process that will be described later has been executed by the signal processing section 22 is converted into an analog signal, amplified, and then supplied to a predetermined speaker unit. A speaker unit used by a particular listener is determined corresponding to position information about listener for example supplied from the camera unit 4. According to this embodiment of the present invention, since the listener 5 uses the speaker unit 3*b*, the audio signal B, which has been processed, is supplied to a D/A converting section 24*b*. The D/A converting section 24*b* converts the audio signal B into an analog signal. An amplifier 25*b* amplifies the analog signal and supplies the amplified signal to the speaker unit 3*b*. The speaker unit 3*b* reproduces the analog signal. Likewise, since the listener 6 uses the speaker unit 3*g*, the audio signal B, which has been processed, is supplied to a D/A converting section 24*g*. The D/A converting section 24*g* converts the audio signal B into an analog signal. An amplifier 25*g* amplifies the analog signal and supplies the amplified signal to the speaker unit 3*g*. The speaker unit 3*g* reproduces the analog signal. Likewise, since the listener 7 uses the speaker unit 3*e*, the audio signal B, which has been processed, is supplied to a D/A converting section 24*e*. The D/A converting section 24*e* converts the audio signal B into an analog signal. An amplifier 25*e* amplifies the analog signal and supplies the amplified signal to the speaker unit 3*e*. The speaker unit 3*e* reproduces the analog signal.

Next, an example of a process executed by the signal processing section 22 according to this embodiment of the present invention will be described. As described above, the signal processing section 22 executes a process of causing the listener 6 to hear the audio signal B and forming low sensitivity regions around the listener 5 and the listener 7 so that they are unable to hear the audio signal B. For simplicity, it is assumed that each speaker unit disposed in the audio reproducing apparatus 1 is a point sound source having no directivity and that the size (namely, diameter) of the audio reproducing apparatus 1 is so small that the size can be ignored against the distance from each speaker unit to the corresponding listener.

Assuming that weighting factors to the audio signals supplied to the speaker units 3*b*, 3*e*, and 3*g* are denoted by α, β, and γ, respectively, the level of the audio signal given to the listener 5 can be expressed by the following formula (1).

$$\alpha \cdot D_{3b\text{-}5} + \beta \cdot D_{3e\text{-}5} + \gamma \cdot D_{3g\text{-}5} = 0 \quad (1)$$

In formula (1), D represents a directivity. For example, $D_{3b\text{-}5}$ represents a directivity (gain) in the direction from the speaker unit 3*b* to the listener 5. $D_{3b\text{-}5}$ is given as a measured numeric value (this applies to the following formulas (2) and (3)). In addition, to form a low sensitivity region around the listener 5, the right side of formula (1) as a result of the sum of directivities is set to 0.

The signal level of the audio signal given to the listener 6 can be expressed by the following formula (2).

$$\alpha \cdot D_{3b\text{-}6} + \beta \cdot D_{3e\text{-}6} + \gamma \cdot D_{3g\text{-}6} = 0 \quad (2)$$

Like the listener 5, to form a low sensitivity region around the listener 6, the right side of formula (2) as a result of the sum of directivities is set to 0.

The signal level of the audio signal given to the listener 7 can be expressed by the following formula (3).

$$\alpha \cdot D_{3b\text{-}7} + \beta \cdot D_{3e\text{-}7} + \gamma \cdot D_{3g\text{-}7} = a \quad (3)$$

To cause the listener 7 to hear the audio signal B, the right side of formula (3) is set to a, which represents the gain of the audio signal B.

Since the directivity D and the gain a are given as numeric values, by solving formula (1) to formula (3), the values of α, β, and γ can be obtained. A signal of which the audio signal B is multiplied by α is supplied to the speaker unit 3*b*. A signal of which the audio signal B is multiplied by β is supplied to the speaker unit 3*e*. A signal of which the audio signal B is multiplied by γ is supplied to the speaker unit 3*g*. The speaker units 3*b*, 3*e*, and 3*g* reproduce these signals.

Thus, since audio signals of which the audio signal B has been multiplied by α, β, and γ are reproduced from the speaker units 3*b*, 3*c*, and 3*g*, low sensitivity regions can be formed around the listener 5 and the listener 6 so that they are unable to hear the audio signal B or they weakly hear the audio signal B. On the other hand, since the audio signal B having gain a is reproduced, the listener 7 can hear the audio signal B.

In the foregoing formulas (1) to (3), the directivity D depends on the frequency. Thus, it is preferred that the formulas (1) to (3) be solved for each frequency. However, for frequencies at which patterns of directivities are likely to be the same, the formulas (1) to (2) may be solved assuming that these frequencies are the same.

It should be understood by those skilled in the art that various modifications, combinations, sub-combinations and alternations may occur depending on design requirements and other factors insofar as they are within the scope of the appended claims or the equivalents thereof. For example, in the foregoing embodiment, the audio reproducing apparatus was described assuming that it has a circularly cylindrical shape. Instead, the audio reproducing apparatus may have a polygonal section such as a square section or a pentagonal section on each side of which speaker units may be disposed.

In addition, each section of the audio reproducing apparatus may be made up of a dedicated hardware circuit, a method, or a programmed computer. In addition, the program describing the process may be recorded on a magnetic recording unit or a computer readable record medium such as an optical disc, a magneto-optical disc, or a semiconductor memory.

What is claimed is:

1. An audio reproducing apparatus, comprising:

a plurality of speaker units whose radiation surfaces face outwardly away from one another; and a directivity controlling means for controlling directivities of the plurality of speaker units so that a sum of the directivities of the plurality of speaker units becomes 0 so as to form at least one low sensitivity region where audio signals generated from a speaker of the plurality of speaker units not facing a listening position are suppressed and unable to be heard by a listener located at the listening position.

2. The audio reproducing apparatus as set forth in claim 1, wherein the directivity controlling means calculates weighting factors for the plurality of speaker units so that the sum of the directivities of the plurality of speaker units becomes 0, and wherein audio signals multiplied by the weighting factors are supplied to the plurality of speaker units and reproduced therefrom.

3. The audio reproducing apparatus as set forth in claim 1, further comprising:

determining means for determining the positions of listeners, wherein the directivity controlling means controls the directivities of the plurality of speaker units corresponding to information about the positions of the listeners supplied from the determining means.

4. The audio reproducing apparatus as set forth in claim 3, wherein the determining means comprises at least one of a camera unit, an ultrasonic wave emitting device, an infrared ray emitting device or a sound wave detection device.

5. The audio reproducing apparatus as set forth in claim 4, wherein the camera unit is adapted to capture images in directions 360 degrees around and the determining means is configured to analyze captured image data from the camera unit to determine the positions of listeners.

6. The audio reproducing apparatus as set forth in claim 4, wherein the ultrasonic wave emitting device is adapted to emit an ultrasonic wave in a radial direction of each speaker unit and the determining means is configured to detect a reflection wave from each listener against the ultrasonic wave to determine the positions of listeners.

7. The audio reproducing apparatus as set forth in claim 4, wherein the determining means is configured to detect a time difference between a time at which each listener speaks and a time at which a sound wave of the listener reaches one of the plurality of speaker units to determine the positions of listeners.

8. The audio reproducing apparatus as set forth in claim 1, wherein the plurality of speaker units are radially disposed on a plurality of baffle plates disposed on a surface of a cylindrical enclosure.

9. An audio reproducing apparatus, comprising:

a plurality of speaker units whose radiation surfaces face outwardly away from one another, wherein weighting factors for the plurality of speaker units are calculated so that the sum of the directivities of the plurality of speaker units becomes 0, and wherein audio signals multiplied by the weighting factors are supplied to the plurality of speaker units and reproduced therefrom so as to form at least one low sensitivity region where audio signals generated from a speaker of the plurality of speaker units not facing a listening position are suppressed and unable to be heard by a listener located at the listening position.

10. An audio reproducing method of reproducing audio signals from a plurality of speaker units, comprising the step of:

controlling directivities of the plurality of speaker units so that the sum of the directivities of the plurality of speaker units becomes 0 so as to form at least one of low sensitivity region where sound generated from a speaker of the plurality of speaker units not facing a listening position are suppressed and unable to be heard by a listener located at the listening position.

11. An audio reproducing apparatus, comprising:

a plurality of speaker units whose radiation surfaces face outwardly away from one another; and a directivity controlling section which controls directivities of the plurality of speaker units so that a sum of the directivities of the plurality of speaker units becomes 0 so as to form at least one of low sensitivity region where sound generated from a speaker of the plurality of speaker units not facing a listening position are suppressed and unable to be heard by a listener located at the listening position.

* * * * *